United States Patent [19]

Malec

[11] 4,248,182

[45] Feb. 3, 1981

[54] ANTI-WEAR ADDITIVES IN DIESEL FUELS

[75] Inventor: Robert E. Malec, Birmingham, Mich.

[73] Assignee: Ethyl Corporation, Richmond, Va.

[21] Appl. No.: 72,031

[22] Filed: Sep. 4, 1979

[51] Int. Cl.[3] ..... C10L 1/18

[52] U.S. Cl. ..... 123/1 A; 44/53; 44/56; 44/57; 44/66; 123/198 A

[58] Field of Search ..... 44/53, 56, 66, 57; 123/1 A, 198 A

[56] References Cited

U.S. PATENT DOCUMENTS

| | | | |
|---|---|---|---|
| 1,591,665 | 6/1926 | Esselen, Jr. | 44/53 |
| 2,934,048 | 4/1960 | Young | 44/57 |
| 3,082,070 | 3/1963 | Eckert | 44/53 |

*Primary Examiner*—Jacqueline V. Howard

*Attorney, Agent, or Firm*—Donald L. Johnson; Joseph D. Odenweller; Willard G. Montgomery

[57] ABSTRACT

An anti-wear compression ignition fuel for use in diesel engines comprising (1) a monohydroxy alkanol having from 1 to 5 carbon atoms, and (2) a wear inhibiting amount of a $C_8$ to $C_{20}$ aliphatic monocarboxylic acid. Optionally, said fuel composition may also contain an ignition accelerator such as an organic nitrate.

22 Claims, No Drawings

ANTI-WEAR ADDITIVES IN DIESEL FUELS

BACKGROUND OF THE INVENTION

It has recently been disclosed in Brazilian Patent Application No. P17700392 that alcohols, such as methanol and ethanol, can be substituted for conventional petroleum derived diesel fuels for burning in diesel engines, when used in combination with an ignition accelerator, such as ethyl nitrate or nitrite. Reportedly, the addition of alkyl nitrate or nitrite accelerators to the alcohol achieves a level of auto-ignition sufficient to operate in diesel engines. Unfortunately, these fuel compositions, devoid of any petroleum derived products, are notably deficient in lubricity or lubricating properties with the result that engine wear from the use of these fuels in internal combustion reciprocating diesel engines is a serious problem. Of particular concern are wear problems associated with the fuel injector mechanisms used in such engines. Wear problems have also been encountered in diesel engines operating on light diesel fuel oils as disclosed in U.S. Pat. No. 4,002,437. The addition of carboxylic acids, such as oleic acid, to lubricating oils for the purpose of improving the lead-bearing properties of such lubricants has long been recognized in the art as disclosed in U.S. Pat. No. 2,921,903. It is also known in the art that the addition of the reaction product of oleic acid and an aminopyridine to lubricating oils confers metal corrosion inhibiting properties to the lubricants as disclosed in U.S. Pat. No. 3,884,822.

SUMMARY OF THE INVENTION

It has now been found that the addition of a $C_8$ to $C_{20}$ aliphatic monocarboxylic acid to compression ignition fuels adapted for use in diesel engines comprising a monohydroxy alkanol having from 1 to 5 carbon atoms and optionally containing an ignition accelerator, such as an organic nitrate, can significantly improve the wear characteristics of said fuels.

DESCRIPTION OF THE PREFERRED EMBODIMENTS

A preferred embodiment of the present invention is an anti-wear compression ignition fuel for use in diesel engines comprising (1) a monohydroxy alkanol having from 1 to 5 carbon atoms, and (2) a wear inhibiting amount of a $C_8$ to $C_{20}$ aliphatic monocarboxylic acid.

Another embodiment of the present invention is an anti-wear compression ignition fuel for use in diesel engines comprising (1) a monohydroxy alkanol having from 1 to 5 carbon atoms, (2) an ignition accelerator, and (3) a wear inhibiting amount of a $C_8$ to $C_{20}$ aliphatic monocarboxylic acid.

A further embodiment of the present invention is a method for inhibiting engine wear in an internal combustion reciprocating diesel engine operating on a compression ignition fuel comprising (1) a monohydroxy alkanol having from 1 to 5 carbon atoms, (2) an ignition accelerator, and (3) a wear inhibiting amount of a $C_8$ to $C_{20}$ aliphatic monocarboxylic acid, said method comprising (a) supplying to the fuel induction system of said engine said compression ignition fuel, (b) inducting air into the combustion chambers of said engine, (c) compressing said air, (d) injecting said compression ignition fuel into said combustion chambers containing said compressed air, (e) igniting said compressed mixture, and (f) exhausting the resultant combustion products resulting in reduced engine wear in said engine.

Monohydroxy alcohols which can be used in the present invention include those containing from 1 to 5 carbon atoms. Preferred alcohols are saturated aliphatic monohydric alcohols having from 1 to 5 carbon atoms. Methanol, ethanol, propanol, n-butanol, isobutanol, amyl alcohol and isoamyl alcohol are preferred alcohols for use in the present invention. Of these ethanol is the most preferred.

The anti-wear components of the fuel composition of the present invention are aliphatic monocarboxylic acids having from 8 to 20 carbon atoms. Preferred acids are caprylic acid, pelargonic acid, capric acid, undecylic acid, lauric acid, tridecoic acid, myristic acid, stearic acid, linoleic acid and the like.

More preferably, the acid is an unsaturated fatty acid such as hypogeic acid, oleic acid, linoleic acid, elaidic acic, erucic acid, brassidic acid and the like.

Most preferably, the acid is oleic acid. Methods of preparing these acids are well known. Such methods include, for example, oxidation of primary alcohols and the carbonation of Grignard reagents.

Optionally, an ignition accelerator can be added to the fuel compositions of the present invention. The ignition accelerator component of the anti-wear compression ignition fuel composition of the present invention is an organic nitrate. Preferred organic nitrates are substituted or unsubstituted alkyl or cycloalkyl nitrates having up to about 10 carbon atoms, preferably from 2 to 10 carbon atoms. The alkyl group may be either linear or branched. Specific examples of nitrate compounds suitable for use in the present invention include, but are not limited to the following:

methyl nitrate
ethyl nitrate
n-propyl nitrate
isopropyl nitrate
allyl nitrate
n-butyl nitrate
isobutyl nitrate
sec-butyl nitrate
tert-butyl nitrate
n-anyl nitrate
isoamyl nitrate
2-amyl nitrate
3-amyl nitrate
tert-amyl nitrate
n-hexyl nitrate
2-ethylhexyl nitrate
n-heptyl nitrate
sec-heptyl nitrate
n-octyl nitrate
sec-octyl nitrate
n-nonyl nitrate
n-decyl nitrate
cyclopentylnitrate
cyclohexylnitrate
methylcyclohexyl nitrate
isopropylcyclohexyl nitrate and the esters of alkoxy substituted aliphatic alcohols, such as 1-methoxypropyl-2-nitrate, 1-ethoxpropyl-2-nitrate, 1-isopropoxy-butyl nitrate, 1-ethoxybutyl nitrate and the like. Preferred alkyl nitrates are ethyl nitrate, propyl nitrate, amyl nitrates and hexyl nitrates. Other preferred alkyl nitrates are mixtures of primary amyl nitrates or primary hexyl nitrates. By primary is meant that the nitrate functional group is attached to a carbon atom which is attached to two hydrogen atoms. Examples of primary hexyl nitrates would be n-hexyl nitrate, 2-ethylhexyl nitrate, 4-methyl-n-pentyl nitrate and the like. Preparation of the nitrate esters may be accomplished by any of the commonly used methods; such as, for example, esterification of the appropriate alcohol, or reaction of a suitable alkyl halide with silver nitrate.

Other conventional ignition accelerators may also be used in the present invention, such as hydrogen peroxide, benzoyl peroxide, etc. Further certain inorganic and organic chlorides and bromides, such as, for example, aluminum chloride, ethyl chloride or bromide may find use in the present invention as primers when used in combination with the alkyl nitrate accelerators of the present invention.

The amount of carboxylic acid used in the compression ignition fuel compositions of the present invention should be an amount sufficient to provide the desired wear protection. This concentration is conveniently expressed in terms of weight percent of acid based on the total weight of the compression ignition fuel composition. A preferred range is from about 0.01 to about 2.0 weight percent. A more preferred range is from about 0.1 to about 1.0 weight percent.

The amount of alkyl nitrate or nitrate ignition accelerator used should be an amount which will achieve the level of auto-ignition sufficient to allow the operation of diesel engines on the fuel composition of the present invention. A useful range is from about 0.1 weight percent to about 10.0 weight percent based on the total compression ignition fuel composition. Preferred amounts are between 0.5 weight percent and 3.0 weight percent.

Other additives may be used in formulating the compression ignition fuel compositions of the present inventions. These compounds include demulsifying agents, corrosion inhibitors, antioxidants, dyes, and the like, provided they do not adversely effect the anti-wear effectiveness of the carboxylic acid additives.

Conventional blending equipment and techniques may be used in preparing the fuel composition of the present invention. In general, a homogeneous blend of the foregoing active components is achieved by merely blending the acid component of the present invention with the monohydroxy alkanol and, if desired, an ignition accelerator in a determined proportion sufficient to reduce the wear tendencies of the fuel. This is normally carried out at ambient temperature. The following examples illustrate the preparation of some typical fuel compositions of the present invention.

EXAMPLE I 9.9 grams of 190 proof ethanol and 0.1 gram of oleic acid were deposited in a blending vessel. The mixture was stirred at room temperature until homogenous forming a fuel composition useful for reducing and/or inhibiting the amount of engine wear in internal combustion reciprocating diesel engines operating on said fuel composition.

EXAMPLE II 49.95 grams of 190 proof ethanol, 0.05 grams of oleic acid, and 2.5 grams of n-propyl nitrate were deposited in a blending vessel. The mixture was stirred at room temperature until homogenous forming a fuel composition useful for reducing and/or inhibiting the amount of engine wear in internal combustion reciprocating diesel engines operating on said fuel composition.

The amounts of each ingredient in the foregoing compositions can be varied within the limits aforediscussed to provide the optimum degree of each property.

The lubricity or wear properties of the fuel compositions were determined in the 4-Ball Wear Test. This test is conducted in a device comprising four steel balls, three of which are in contact with each other in one plane in a fixed triangular position in a reservoir containing the test sample. The fourth ball is above and in contact with the other three. In conducting the test, the upper ball is rotated while it is pressed against the other three balls while pressure is applied by weight and lever arms. The diameter of the scar on the three lower balls are measured by means of a low power microscope, and the average diameter measured in two directions on each of the three lower balls is taken as a measure of the anti-wear characteristics of the fuel. A larger scar diameter means more wear. The balls were immersed in base fuel containing the test additives. Applied load was 5 kg and rotation was at 1,800 rpm for 30 minutes at ambient temperature. Tests were conducted both with base fuel* alone and with the fuel compositions prepared as described in Examples I and II, above. Results are as follows:

| Fuel | Scar Diameter (mm) Run 1 | Run 2 |
|---|---|---|
| Base Fuel | 0.89 | 0.90 |
| Example I | 0.32 | |
| Example II | 0.51 | |

* Base fuel was 190 proof ethanol.

In two separate tests, the test fuels without any additive gave scar diameters of 0.89 and 0.90 mm, respectively. The addition to the base fuel of oleic acid at a concentration of 1.0 weight percent significantly reduced the wear index to 0.32 mm. The addition of oleic acid at a concentration of 1.0 weight percent to the base fuel containing 2.5 grams of n-propyl nitrate reduced the wear index to 0.51 mm.

An additional 4-Ball Wear Test in which the applied load was increased to 10 kg. showed a reduction in scar diameter from 0.92 mm for 190 proof ethanol to 0.45 mm for 190 proof ethanol containing 1.0 weight percent oleic acid. Thus, the incorporation of oleic acid into alcohol or alcohol containing fuels significantly increases the wear inhibiting properties of these fuels. The fact that oleic acid increases the wear inhibiting properties of these fuels suggests that other related acids such as those aforediscussed also will increase the wear inhibiting properties of these fuels.

The wear inhibiting agents of the present invention are also effective in increasing the wear inhibiting properties of fuel compositions comprising mixtures of monohydroxy alkanols having from 1 to 5 carbon atoms and fuel oil boiling above the gasoline boiling range, i.e. a mixture of hydrocarbons boiling in the range of about 300° F. to about 700° F. Such compositions may also contain ignition accelerators such as the organic nitrates referred to previously.

Thus, another embodiment of the present invention is an anti-wear compression ignition fuel for use in diesel engines comprising a mixture of monohydroxy alkanols having from 1 to 5 carbon atoms, fuel oil boiling above the gasoline boiling range and a wear inhibiting amount of a $C_8$ to $C_{20}$ aliphatic carboxylic acid.

I claim:

1. As a new composition of matter, an anti-wear compression ignition fuel for use in diesel engines comprising (1) a monohydroxy alkanol having from 1 to 5 carbon atoms, (2) an ignition accelerator, and (3) a wear inhibiting amount of a $C_8$ to $C_{20}$ aliphatic monocarboxylic acid.

2. The composition of claim 1 wherein said monohydroxy alkanol is ethanol.

3. The composition of claim 1 wherein said ignition accelerator is a substituted or unsubstituted alkyl or cycloalkyl nitrate having up to ten carbon atoms.

4. The composition of claim 1 wherein said acid is oleic acid.

5. The composition of claim 1 wherein said acid is linoleic acid.

6. The composition of claim 2 wherein said ignition accelerator is selected from methyl nitrate, ethyl nitrate, propyl nitrate, amyl nitrates, hexyl nitrates or a mixture of primary amyl nitrates and primary hexyl nitrates.

7. The composition of claim 6 wherein said ignition accelerator is ethyl nitrate.

8. The composition of claim 6 wherein said acid is oleic acid.

9. The composition of claim 6 wherein said acid is linoleic acid.

10. The composition of claim 8 containing from about 0.1 to about 10.0 weight percent ignition accelerator and from about 0.01 to about 2.0 weight percent oleic acid based on the total weight of said composition.

11. The composition of claim 9 containing from about 0.1 to about 10.0 weight percent ignition accelerator and from about 0.01 to about 2.0 weight percent linoleic acid.

12. A method for inhibiting engine wear in an internal combustion reciprocating diesel engine operating on a compression ignition fuel comprising (1) a monohydroxy alkanol having from 1 to 5 carbon atoms, (2) an ignition accelerator, and (3) a wear inhibiting amount of a $C_8$ to $C_{20}$ aliphatic monocarboxylic acid, said method comprising (a) supplying to the fuel induction system of said engine said compression ignition fuel,
(b) inducting air into the conbustion chambers of said engine,
(c) compressing said air,
(d) injecting said compression ignition fuel into said combustion chambers containing said compressed air,
(e) igniting said compressed mixture, and
(f) exhausting the resultant combustion products resulting in reduced engine wear in said engine.

13. The method of claim 12 wherein said monohydroxy alkanol is ethanol.

14. The method of claim 12 wherein said ignition accelerator is a substituted or unsubstitued alkyl or cycloalkyl nitrate having up to ten carbon atoms.

15. The method of claim 12 wherein said acid is oleic acid.

16. The method of claim 12 wherein said acid is linoleic acid.

17. The method of claim 13 wherein said ignition accelerator is selected from methyl nitrate, ethyl nitrate, propyl nitrate, amyl nitrates, hexyl nitrates or a mixture of primary amyl nitrates and primary hexyl nitrates.

18. The method of claim 17 wherein said ignition accelerator is ethyl nitrate.

19. The method of claim 17 wherein said acid is oleic acid.

20. The method of claim 17 wherein said acid is linoleic acid.

21. The method of claim 19 wherein said ignition accelerator is present in an amount of from about 0.1 weight percent to about 10.0 weight percent based on the total weight of said composition and said oleic acid is present in an amount of from about 0.01 to about 2.0 weight percent based on the total weight of the composition.

22. The method of claim 20 wherein said ignition accelerator is present in an amount of from about 0.1 weight percent to about 10.0 weight percent based on the total weight of said composition and said linoleic acid is present in an amount of from about 0.01 to about 2.0 weight percent based on the weight of said composition.

* * * * *